US005447372A

United States Patent [19]

Araki et al.

[11] Patent Number: 5,447,372

[45] Date of Patent: Sep. 5, 1995

[54] DISPERSING APPARATUS

[75] Inventors: Yoshitaka Araki; Hideyuki Araki, both of Tokyo, Japan

[73] Assignee: Araki Iron Works Co., Ltd., Saitama, Japan

[21] Appl. No.: 259,286

[22] Filed: Jun. 13, 1994

[30] Foreign Application Priority Data

Jul. 20, 1993 [JP] Japan ..... 5-179371

[51] Int. Cl.[6] ..... B01F 7/16; B01F 7/32

[52] U.S. Cl. ..... 366/299; 366/264; 366/285; 366/286; 366/291

[58] Field of Search ..... 366/279, 297, 298, 299, 366/300, 262, 263, 264, 265, 285, 286, 289, 290, 291, 64, 65, 166

[56] References Cited

U.S. PATENT DOCUMENTS

| | | | |
|---|---|---|---|
| 2,718,385 | 9/1955 | Greblick | 366/264 |
| 4,091,463 | 5/1978 | Tschudy | 366/300 |
| 4,190,371 | 2/1980 | Durr | 366/294 |
| 4,898,474 | 2/1990 | Lipson | 366/286 |
| 5,278,805 | 1/1994 | Johnson | 366/265 |

*Primary Examiner*—Robert W. Jenkins

*Attorney, Agent, or Firm*—Joseph C. Mason, Jr.; Ronald E. Smith

[57] ABSTRACT

A basket is so disposed that a portion of the outer periphery thereof is faced to the inner peripheral wall on one side of the tank. The starting materials thrown from the hopper portion formed on the other side of the tank which is opposite to the above inner peripheral wall, are efficiently premixed by the secondary vanes that are rotating near the center of the tank under the basket. The grains of the blend are dispersed by the primary vanes that are rotating in the basket 20 and pass through the slits formed by numerous wires having a circular shape in cross section in the side wall of the basket. Due to the whirling current or vortex current in the basket near the opening and in the tank produced by the stirrer means made up of grooves and/or vanes under the top cover that is provided at the upper portion of the side wall of the basket, the blend near the opening is introduced again into the basket from the inclined surface of the top cover that is downwardly inclined toward the center of the opening together with the dispersing media that have flown from the basket, and is dispersed again.

11 Claims, 11 Drawing Sheets

(A)

(B)

(A)

(B)

DISPERSING APPARATUS

BACKGROUND OF THE INVENTION

1. Field of the Invention

The present invention relates to a dispersing apparatus for dispersing in a finely granulated form a liquid blend which contains solid matters such as paints, inks and like pigments, as well as a resin varnish, a solvent and additives (as required).

2. Description of the Prior Art

In a conventional dispersing apparatus of this type as shown in, for example, FIG. 1, an apparatus body 10 is provided on a cylinder 53 of an elevator device 50, such as a hydraulic cylinder that moves up and down, and primary vanes 14 are provided at the end of a main shaft 12 that is rotated via a V-belt or the like means by a motor 41 which is installed in the apparatus body 10. The primary vanes 14 are allowed to rotate in a basket 20 that is firmly fastened to the lower side of the apparatus body 10 by rods 13 and that is disposed nearly at the center of a tank 60 so as to disperse a liquid blend 65 that contains solid matters such as paints, inks and like pigments. The basket 20 contains dispersing media 37 such as glass balls, steel balls, ceramic balls and zirconia balls.

The tank 60 has a drain valve 61 provided in a side wall which is continuous to the bottom wall of the vessel, and further has wheels 62 provided on the lower surface of the bottom wall, so that it can be moved.

Moreover, a sub-shaft 46 is driven being directly coupled to a motor 48 and moves up and down together with the apparatus body 10. Secondary vanes 47 are attached to an end of the sub-shaft 46, and is located at a lower portion in the tank 60 outside the basket 20 being spaced apart therefrom.

The basket 20 has numerous pores formed in the side walls thereof. The pores are formed by using a mesh-like wire gauze having a number of fine holes or slits perforated therein.

The basket has in the upper surface thereof an opening at a central portion in which the main shaft will be inserted and through which will be introduced the liquid blend that contains solid matters such as paints, inks and like pigments inside the tank. The basket further has a top cover that is fastened to the top flange thereof, the top cover being made of a thin metal plate having an upper guide surface for preventing the dispersing media from escaping and for guiding the blend into the opening.

In general, pigments that are placed in the market are aggregated and are forming Secondary grains (primary grains of the pigment are usually smaller than 1 micron). When used in their own forms, therefore, the pigments precipitate and are separated while the paint is being preserved. Even when the pigments are stirred, the obtained coated film is not beautifully finished due to aggregates of secondary grains. To overcome this problem, in general, the liquid blend containing solid matters such as pigments, a resin varnish, a solvent and additives (used as required), is dispersed and is finely granulated through the steps of premixing and dispersion.

In the premixing, the varnish and the pigment are mixed together, and the secondary grains of the pigment are wet with the varnish to form a paste thereof, which facilitates the subsequent step of dispersion.

In the conventional premixing method, the resin, solvent and the like are thrown into the tank 60 to about one-third the depth of the tank 60 at a place other than the place where the dispersing apparatus is placed, and the pigment is then thrown therein. The mixture is then premixed using a mixer (e.g., a simply constructed mixer by attaching vanes to the end of a long shaft coupled to a motor) to obtain a paste-like mixture thereof. After the pigment is thrown in a whole amount into the tank 60, a solvent and the like are then thrown therein to dilute the mixture.

In the following step of dispersion, the tank 60 is moved to the place where the dispersing apparatus exists, the elevator device 50 is operated to lower the device body 10, and the basket 20 and the secondary vanes 47 are submerged in the blend 65 in the tank 60. As the motor 41 and the motor 48 are driven to rotate the primary vanes 14 the secondary vanes 47, large grains in the blend 65 in the basket 20 are finely dispersed due to shearing stress between the dispersing media 37 and the blend in the basket 20, whereby finely dispersed grains flow out through pores, mesh or slits in the side walls of the basket 20, undergo convection in the tank 60, flow again into the basket 20 from the upper direction, and are dispersed more finely (for example, see Japanese Patent KOKAI NOs. S60-122033, S61-293536 and H3-72932).

The conventional dispersing apparatuses, however, leave the below-mentioned problems unsolved.

(1) To carry out the steps of premixing and dispersion using the conventional dispersing apparatus, the tank 60 must be installed on the dispersing apparatus after the basket 20 and the secondary vanes 47 are raised. Under this condition, a blend of resin, solvent, pigment, etc. is thrown into the tank 60. The basket 20 and the secondary vanes 47 are then lowered to premix the blend by the secondary vanes 47. That is, the secondary vanes 47 are located near the inner peripheral wall of the tank 60, and the blend in the tank 60 is not stirred to a sufficient degree.

(2) In the premixing step, the pigment is thrown little by little into the mixture of the resin and the solvent that is being stirred by the secondary vanes 47 to accomplish better stirring efficiency. Because of the reason mentioned in (1) above, however, the basket 20 and the secondary vanes 47 are lowered after the blend of resin, solvent and pigment is thrown in, and the premixing is effected by the secondary vanes 47 or the pigment is thrown in little by little while frequently ascending and descending the secondary vanes 47, resulting in a poor production efficiency.

(3) Because of the reasons mentioned in (1) and (2), therefore, the blend must be thrown into the tank 60 and must be premixed in another place arousing, however, the following problems.

(3-1) A place is required for placing the tank 60 for premixing.

(3-2) Premixing efficiency is poor since the premixing is carried out using a simply constructed mixer. A large mixing device for improving premixing efficiency requires an increased cost for facilities, as a matter of course.

(3-3) After the premixing, manpower and time are required for moving the tank 60 to the dispersing apparatus.

(3-4) With the movable tank 60 equipped with wheels, limitation is imposed on the capacity thereof, i.e., from 500 to 1000 liters, making it difficult to construct the tank 60 in a large size. This makes it impossible to batchwisely process the blend in large amounts.

(4) To disperse many kinds of paints in succession, attention must be given so that the paints are not mixed into each other. Therefore, the tank 60, the members such as basket 20 and secondary vanes 47 in the dispersing apparatus, must be completely washed after one paint is dispersed but before starting the dispersion processing of another paint. In the conventional dispersing apparatus, however, the tank 60 is washed after moved to another place from the dispersing apparatus, and the members such as the basket 20 and the secondary vanes 47 of the dispersing apparatus must, on the other hand, be washed by moving the washing tank to the dispersing apparatus. Thus, cumbersome work is required for the washing operation.

(5) Furthermore, since the guide surface is formed only at a central portion of the top cover at a very shallow angle, the liquid blend containing solid matters such as paints, inks and like pigments in the tank is guided into the basket at a poor efficiency. Besides, dispersion media such as glass balls, steel balls and ceramic balls that fly beyond the top cover through the opening are not recovered into the basket but fall on the tank. Therefore, the dispersion efficiency in the basket is not improved.

(6) Among the solid grains dispersed in the basket 20, those grains larger than the width of the slits are not permitted to pass through the slits and stay inside the basket 20 so as to be further finely dispersed. However, the solid grains of sizes close to the width of the slit may often stick in the slits, causing the slits to be partly clogged and the dispersion efficiency to be decreased.

(7) Laborious work is required for washing the solid matters stuck in the slits.

SUMMARY OF THE INVENTION

The present invention was developed in order to solve the above-mentioned problems, and its principal object is to provide a dispersing apparatus which is capable of premixing and dispersing a liquid blend containing solid matters such as paints, inks and like pigments efficiently, continuously and in large amounts without the need of moving the tank.

Another object of the present invention is to provide a dispersing apparatus which permits the blend near the opening to flow again into the basket together with the dispersing media that flew from inside the basket enabling the convection of blend to be promoted in the tank which helps accomplish stirring and dispersion efficiently.

A further object of the present invention is to provide a dispersing apparatus which is capable of easily washing the tank and the primary vanes or the secondary vanes, or both of these vanes as well as the basket.

In order to accomplish the above-mentioned objects, the present invention deals with a dispersing apparatus wherein a basket 20 containing dispersing media 37 is secured to an apparatus body 10 that can be moved up and down by coupling rods 13 to a sleeve 36 that is formed in a protruding manner in a circumferential direction at an upper part of the side wall 24 of the basket 20, and the apparatus body 10 is provided with a main shaft 12 and a sub-shaft 46 that are rotated by a driving means 11, the main shaft 12 and the sub-shaft 46 being provided with primary vanes 14 and secondary vanes, respectively, so as to rotate in the basket 20 and under the basket to disperse a liquid blend 65 that contains solid matters such as paints, inks and like pigments. The center of the basket 20 is disposed at a position deviated from the center of the tank 60, a hopper portion 34 for throwing the starting materials of the blend 65 is formed between the outer periphery of the basket 20 located near one side of the inner wall of the tank 60 and the inner wall on the opposite side of the tank 60, and the secondary vanes 47 are disposed to rotate near the center of the tank 60 in the hopper portion 34 under the basket.

As for means 11 for driving the main shaft 12 and the sub-shaft 46, the sub-shaft 46 only should be rotated for effecting the premixing, and both the main shaft 12 and the sub-shaft 46 should be rotated for effecting the step of dispersion.

Desirably, furthermore, the apparatus body 10 is allowed to turn in a horizontal direction, and a washing tank 170 and a plurality of tanks 60 are arranged surrounding the apparatus body 10 at such positions that the basket 20 and the secondary vanes 47 can be inserted therein and removed therefrom. Preferably, there should be provided two tanks 60 and one washing tank 170.

In order to constitute the above turning means, a table 55 is secured to the upper end of a cylinder 53, two guide bars 56, 56 are protruded from the lower surface of the table in parallel with the axial direction of the cylinder, the two guide bars being allowed to slide up and down inside cylindrical guides 57, 57 secured to the outer peripheral wall of the box 51 in parallel with the axial direction of the cylinder penetrating through a base 52, and a gear 181 forming a rack along the outer peripheral surface thereof is provided on the upper surface of the table via a thrust bearing 182 of a large diameter to rotate in the horizontal direction, the apparatus body 10 is secured to the upper surface of the gear, and a pinion is provided that meshes with the gear.

Furthermore, the inner peripheral surface of the gear 181 has an upper portion of a large diameter and a lower portion of a small diameter, the outer peripheral edge 99 of a set ring 183 is placed on an upper surface 98 of the inner periphery of the small-diameter portion, a lock bolt 95 is protruded from the lower surface of the set ring 183, the end of the lock bolt 95 is allowed to penetrate through the table 55, and a lock nut 96 which is integrally formed together with a lever 97 is fitted to the end. When the lever 97 is turned in a direction to tighten the lock nut 96, then, the lock nut 96 pulls the outer peripheral edge 99 of the set ring 183 via the lock bolt 95 in a direction to push it onto the upper surface 98 of the inner periphery of the small-diameter portion of the gear 181, whereby the gear 181 is secured to the set ring 183 due to friction between the upper surface 98 of the inner periphery of the small-diameter portion of the gear and the outer peripheral edge 99 of the set ring 183, and the apparatus body 10 is secured at any position in the horizontal direction.

It is desired that the tank 60 has a diameter which is about two times or more as great as the diameter of the basket 20.

In addition to the above-mentioned constitution, furthermore, on an annular top flange having the sleeve is provided a top cover which has an opening at the center thereof and an inclined surface of which the outer circumferential cross section is downwardly inclined toward the center of the opening at an angle over a range of, for example, from about 20 to about 40 degrees, and a stirrer means made up of grooves is provided on the upper surface of a support member disposed under the opening of the top cover. Instead of the grooves, furthermore, there may be provided a stirrer means by forming vanes on the upper surface of the support member. It is further allowable to provide a stirrer means made up of grooves and vanes on the upper surface of the support member.

It is further allowable to provide on the upper surface of the support member a stirrer means made up of a plurality of grooves and/or vanes which extend maintaining an equal distance from the outer peripheral edge of the main shaft or from the vicinities thereof up to the outer peripheral edge of the support member or up to the vicinities thereof, and having a square shape in cross section.

The basket 20 is constituted by a number of wires 27 having a circular shape in cross section that are supported by poles 25 in the up-and-down direction maintaining a very small gap on at least part of the side wall 24 thereof, and slits 35 are formed by the wires 27, 27 that are opposed to each other in parallel in the up-and-down direction and by the poles 25, 25 that are opposed to each other in the circumferential direction.

Though there is no particular limitation, the poles 25 should preferably have a square shape. The poles 25 are arranged on the lower end surface of the sleeve 36 maintaining a suitable gap or, preferably, maintaining a gap of about 100 mm, the axes of the poles 25 being oriented in the up-and-down direction. Moreover, the poles 25 have a number of wire holes 28 formed in the surfaces thereof opposed to the side peripheral wall in the up-and-down direction maintaining a small gap to support the wires 27. The wires 27 are supported being inserted in the opposing wire holes 28; i.e., slits 35 of a very small gap are formed among the wires 27 that are opposing to each other in parallel in the up-and-down direction.

The very small gap of the slits 35 can be set depending upon a desired dispersion condition of the blend 65, but should desirably be 0.8 mm.

The body 10 of the thus constituted dispersing apparatus is lowered to insert the basket 20 and the secondary vanes 47 in a first tank 60, the resin and solvent are thrown into the tank 60 from the hopper portion 34 of the tank 60, and the pigment is thrown little by little into the tank 60 from the hopper portion 34 while rotating the secondary vanes 47 only by the driving means, so that the blend 65 is efficiently premixed into a paste-like mixture.

The solvent is further kept throwing to dilute the blend 65, and the step of dispersion is carried out by rotating the primary vanes and the secondary vanes 47 by the driving means.

The blend 65 in the basket 20 is stirred by the rotation of the stirrer vanes 14, and the solid matters are dispersed into fine grains due to shearing stress between the dispersing media 37 and the solid matters in the blend 65 inside the basket 20.

Due to the centrifugal force produced by the rotation of the primary vanes, the blend in the basket flows toward the outside through numerous pores in the side wall, and the dispersing media partly fly outwardly through the opening of the top cover. Due to whirling current or eddy current in the basket near the opening and in the tank produced by the stirrer means made up of grooves and vanes provided on the upper surface of the support member located under the top cover, however, the blend near the opening flows again into the basket along the inclined surface that is downwardly inclined toward the center of the opening of the top cover together with the dispersing media that flew from the basket, and is dispersed again.

After the dispersing step is finished, the apparatus body 10 is raised to remove the basket 20 and the secondary vanes 47 from the tank 60. The apparatus body 10 is then turned in a horizontal direction to the washing tank 70 in order to submerge the basket 20 and the secondary vanes 47 in the washing solution in the washing tank 170. The basket 20, dispersing media 37, primary vanes 14, rods 13 and wires 27 of the side wall 24 are washed by rotating the primary vanes 14 and the secondary vanes 47.

After the above-mentioned washing step is finished, the apparatus body 10 is raised to remove the basket 20 and the secondary vanes 47 from the washing tank 170. The apparatus body 10 is then turned in the horizontal direction to another tank 60 which is different from the tank 60 used in the above-mentioned step, and another kind of paint is premixed and dispersed in the same manner as that of the aforementioned step of dispersion.

While carrying out the above washing operation and the premixing and dispersion in another tank 60, the blend 65 for which the step of dispersion has been finished is transferred to a subsequent step, and the empty tank 60 is then washed. This tank 60 is used for premixing and dispersing the blend of a further kind in the next time.

BRIEF DESCRIPTION OF THE DRAWINGS

The objects and advantages of the invention will be understood from the following detailed description of preferred embodiments thereof in connection with the accompanying drawings in which like numerals designate like elements, and in which.

DETAILED DESCRIPTION OF THE PREFERRED EMBODIMENTS

Figure 1:
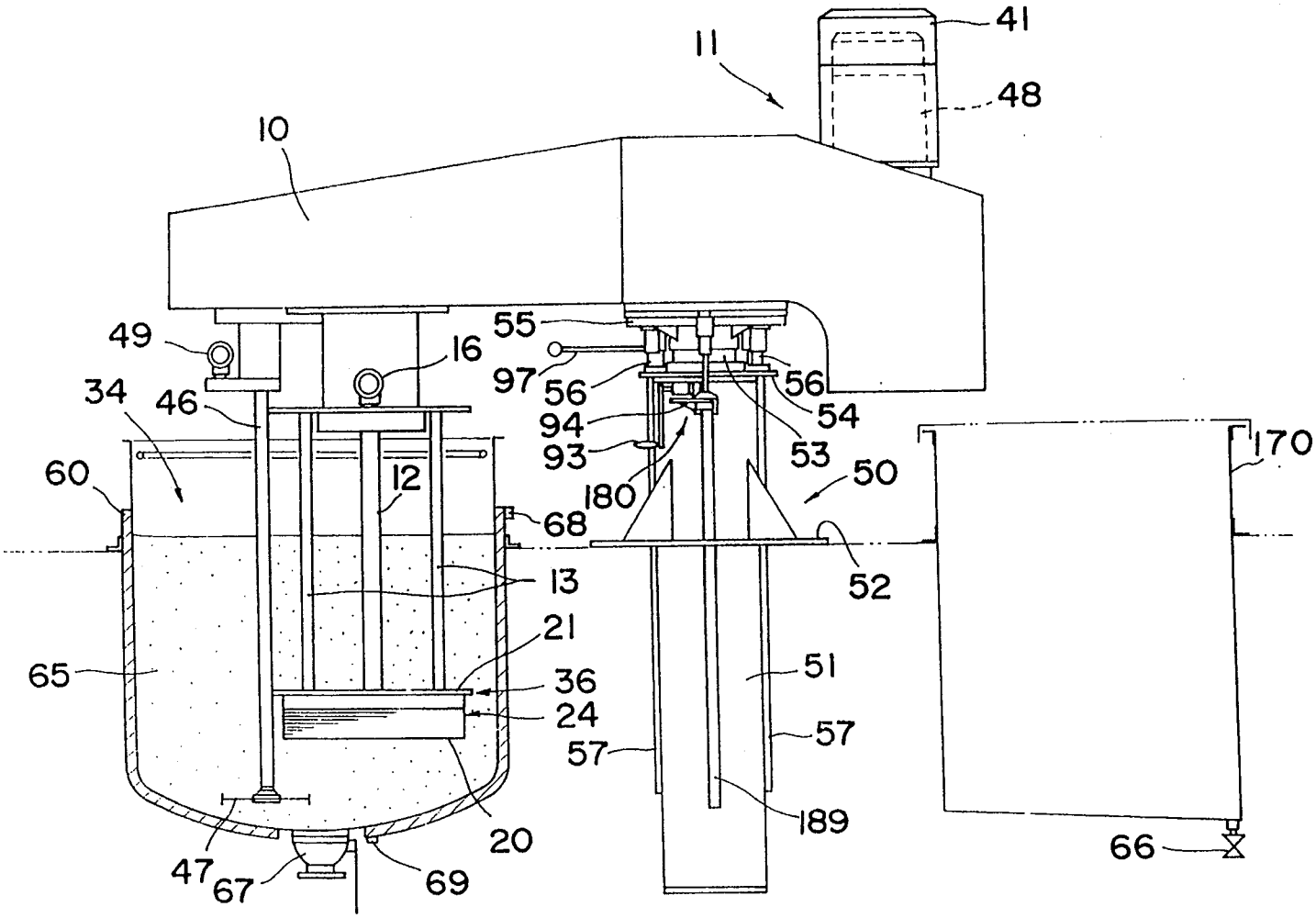
FIG. 1 is a general view of a dispersing apparatus showing part of it in cross section.

In FIG. 1, reference numeral 50 denotes an elevator device. The lower portion of a box 51 is buried in the floor and a base 52 protruded from the outer peripheral wall of the box 51 is secured to the floor surface. Or, the lower portion of the box 51 is placed on the lower layer under the floor. The box 51 includes a cylinder 53 that moves up and down by the hydraulic pressure, and the cylinder 53 can be stopped at any position in the up-and-down direction. On the upper end of the cylinder 53 is provided an apparatus body 10 via a turning means 180 so as to freely turn in a horizontal direction with the cylinder 53 as a center.

The apparatus body 10 may be rotatably provided on the upper end of the cylinder 53 via a thrust bearing of a large diameter, or the apparatus body 10 may be secured to the upper end of the cylinder 53 and the box 51 as a whole may be rotated in the horizontal direction with respect to the floor.

The apparatus body 10 is permitted to rotate when it is raised by the cylinder 53 to a height at which the basket 20 and the secondary vanes 47 hanged down from the end thereof are completely removed from the tank 60 or the washing tank 170. The apparatus body 10 is lowered when the basket 20 and the secondary vanes 47 are turned onto the tank 60 or the washing tank 170 arranged around the elevator device 50 as indicated by a two-dot chain line in FIG. 2.

Elevator Device

Figure 3:
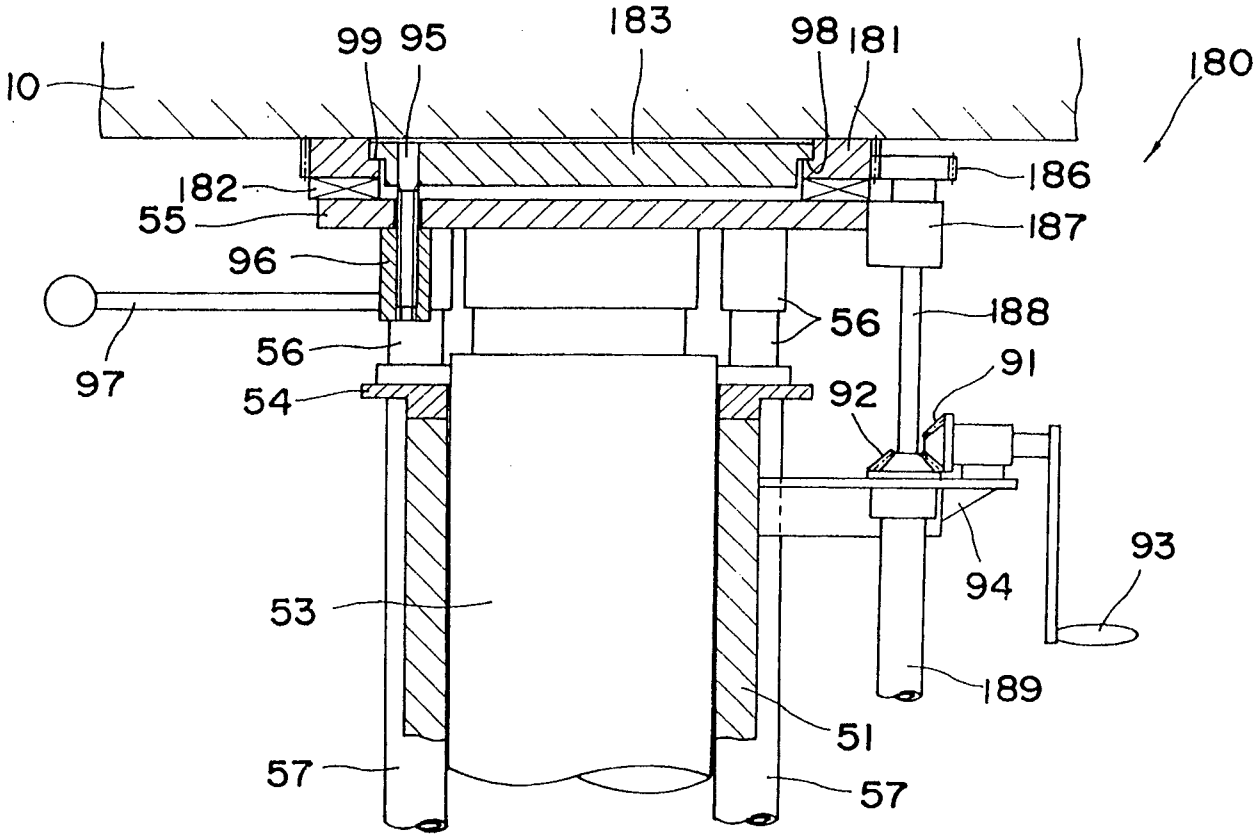
FIG. 3 is a sectional view illustrating major portions of a turning means.
Figure 4:
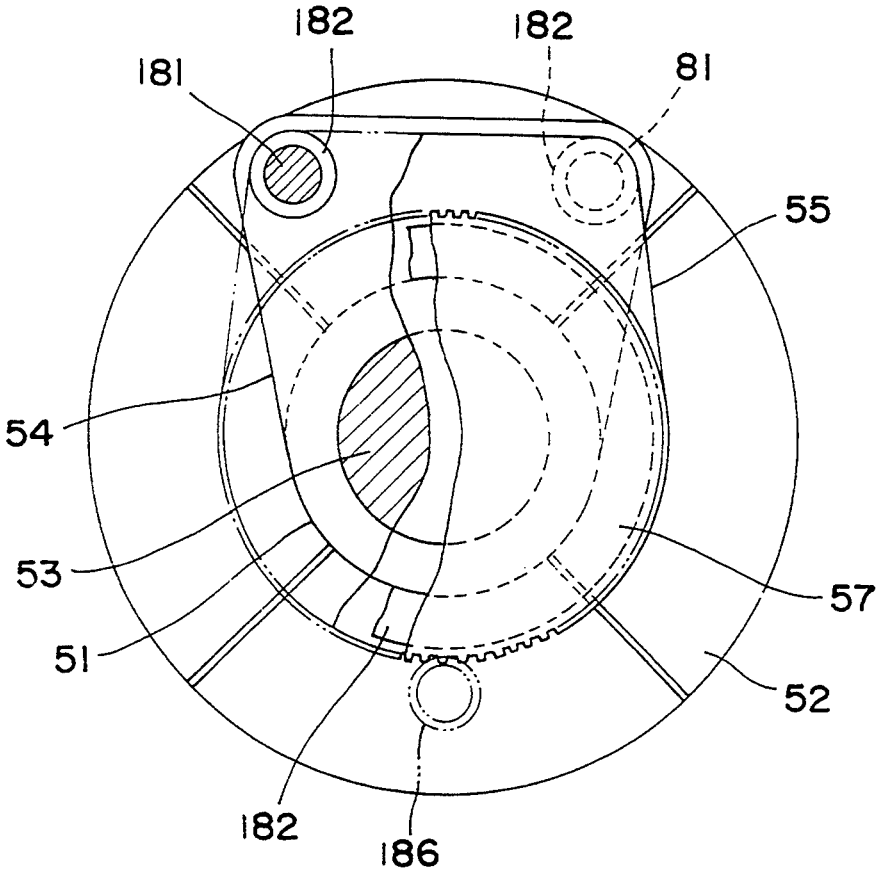
FIG. 4 is a plan view of the turning means showing part of it in cross section.

In FIG. 3, a table 55 (FIG. 4) is secured to the upper end of the cylinder 53, two guide bars 56 are protruded from the lower surface of the table 55 in parallel with the axial direction of the cylinder 53, the two guide bars 56 being allowed to slide up and down in the cylindrical guides 57, 57 secured to the outer peripheral wall of the box 51 in parallel with the axial direction of the cylinder 53 penetrating through the base 52 (FIG. 1), so that the table 55 and the cylinder 53 will not turn inside the box 51. The guides 57, 57 are secured at their upper ends to the bracket 54 (FIG. 4) at the upper end of the box 51 and are secured at their intermediate portions to the base 52.

Turning Means

Turning means 180 will now be described in detail. In FIG. 3, a ring-like gear 181 having an endless rack formed along the outer peripheral surface thereof is provided on the upper surface of the table 55 via a thrust bearing 182 of a large diameter to rotate in a horizontal direction, and the apparatus body 10 is secured to the upper surface of the gear 181. Therefore, the apparatus body 10 is allowed to turn in the horizontal direction with respect to the table 55 at the upper end of the cylinder 53.

The gear 181 is supported by the side wall of the table 55 via pinion 186 (two-dot chain line in FIG. 3 or 4) that is in mesh with the rack and a bearing plate 187, and an end of the pinion 186 is linked through a coupling to the upper end of a spline shaft 188. The shaft 188 moves up and down in a cylindrical shaft guide 189 that is secured to the outer peripheral wall of the box 51 via a bracket 94 (FIG. 3) and the base 52 (FIG. 1) in parallel with the axial direction of the cylinder 53. The shaft guide 189 penetrates through the base 52 as shown in FIG. 1, the upper end of the shaft guide 189 being secured by the bracket and the intermediate portion of the shaft guide 189 being secured by the base 52.

In FIG. 3, reference numeral 92 denotes a second bevel gear which has a spline groove in which the spline shaft 188 can be inserted. The second bevel gear 92 is supported by the bracket 94 near the upper opening of the shaft guide 189, and the spline shaft 188 is inserted in the spline groove of the second bevel gear 92 to move up and down. A first bevel gear 91 that meshes with the second bevel gear 92 is supported by the bracket 94, and a turning handle 93 is coupled to the end of the shaft of the first bevel gear 91.

When the cylinder 53 moves up and down, therefore, the pinion 186 moves up and down in mesh with the gear 181 together with the bearing plate 187 secured to the table 55, and the shaft 188 moves up and down in the spline groove of the second bevel gear 92 and in the shaft guide 189.

The cylinder 53 is raised and is stopped at a desired position and, then, the turning handle 93 is turned. The rotational force of the turning handle 93 is then transmitted from the first bevel gear 91 to the second bevel gear 92 which then rotates the pinion 186 via the shaft 188. The gear 181 is then slowly turned, so that the apparatus body 10 is turned to a desired position in the horizontal direction.

Next, described below is a mechanism for securing the apparatus body 10 at any position in the horizontal direction. The gear 181 is formed in the shape of a ring and has, as shown in FIG. 3, inner peripheral surface of which the upper portion has a large diameter and of which the lower portion has a small diameter. On the upper surface 98 of the inner periphery of the small-diameter portion is placed the outer peripheral edge 99 of a set ring 183 that will be described later.

Reference numeral 183 denotes the set ring of the form of a disk that can be fitted into the hole at the center of the gear 181. The outer peripheral edge 99 of the set ring 183 comes into engagement with the upper surface of the inner periphery of the small-diameter portion of the gear 181. A lock bolt 95 is protruded from the lower surface of the set ring 183, the end of the lock bolt 95 is allowed to penetrate through the table 55, and a lock nut 96 integrally formed together with a lever 97 is screwed to the end.

Therefore, when the lever 97 is turned in a direction to tighten the lock nut 96, the lock nut 96 pulls the outer peripheral edge 99 of the set ring 183 via the lock bolt 95 in a direction to push it onto the upper surface 98 of the inner periphery of the small-diameter portion of the gear 181. Therefore,the gear 181 is secured to the set ring 183 due to the friction between the upper surface 98 of the inner periphery of the small-diameter portion of the gear and the outer peripheral edge 99 of the set ring 183, and the apparatus body 10 is secured at any position in the horizontal direction.

Primary Vanes and Secondary Vanes

Figure 2:
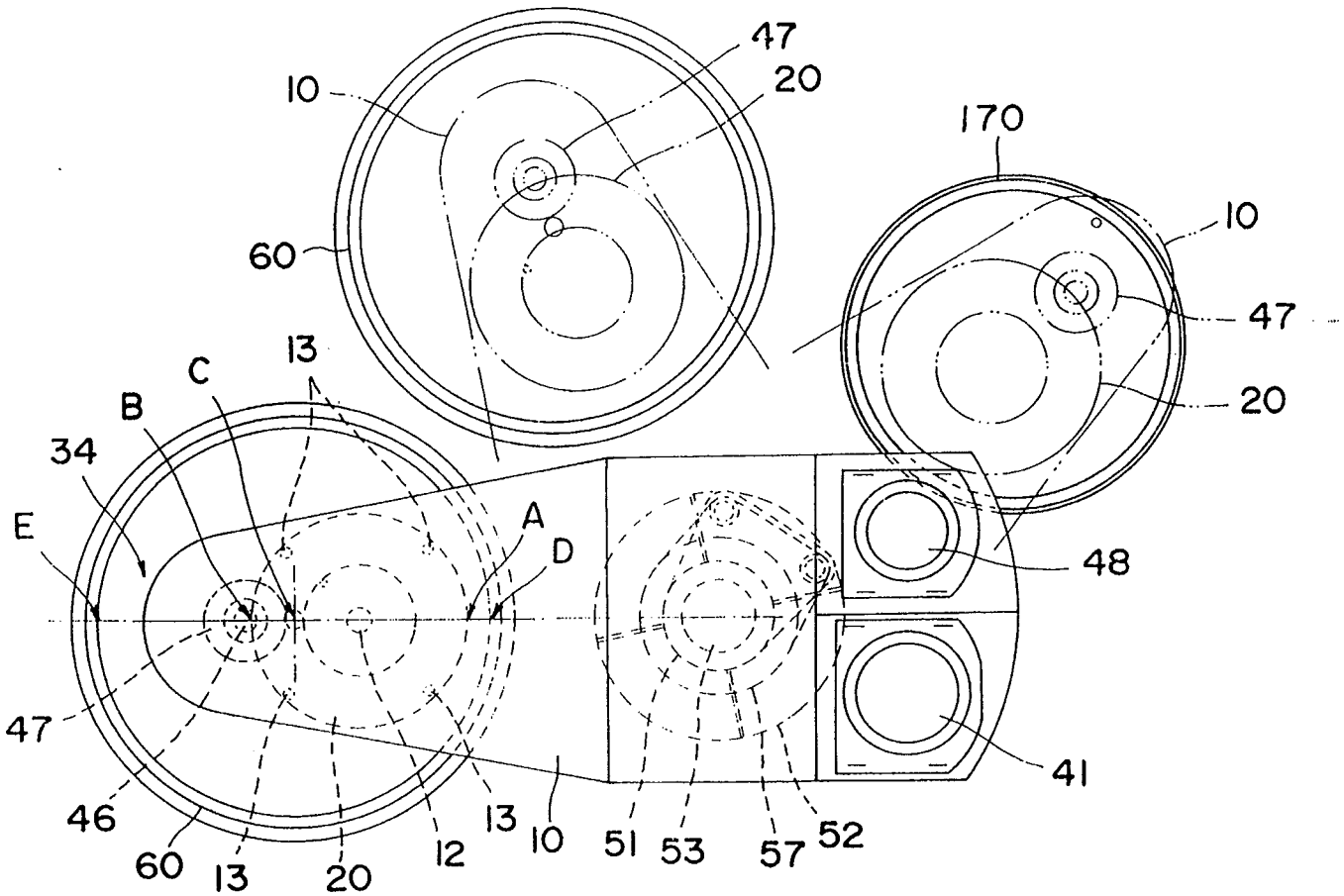
FIG. 2 is a plan view.

From the lower surface at the end of the apparatus body 10 are downwardly extended a main shaft 12 and a sub-shaft 46 nearly in parallel with the axial direction of the cylinder 53. As shown in FIG. 2, the axes of the sub-shaft 46, the main shaft 12 and the cylinder 53 are positioned nearly on a straight line on a plane. The sub-shaft 46 is located near the outside of the basket 20 that will be described later. The primary vanes 14 are attached to the end of the main shaft 12 to rotate on a plane in the basket 20 and at the center of the basket 20. The secondary vanes 47 are attached to the end of the sub-shaft 47 and rotates outside and under the basket 20 near the bottom wall of the tank 60.

A tachometer 16 for indicating the speed of revolution of the main shaft 12 and a tachometer 49 for indicating the speed of revolution of the sub-shaft 46 are provided near the shafts 12 and 46 (FIG. 1).

Stirrer Means

Figure 6:
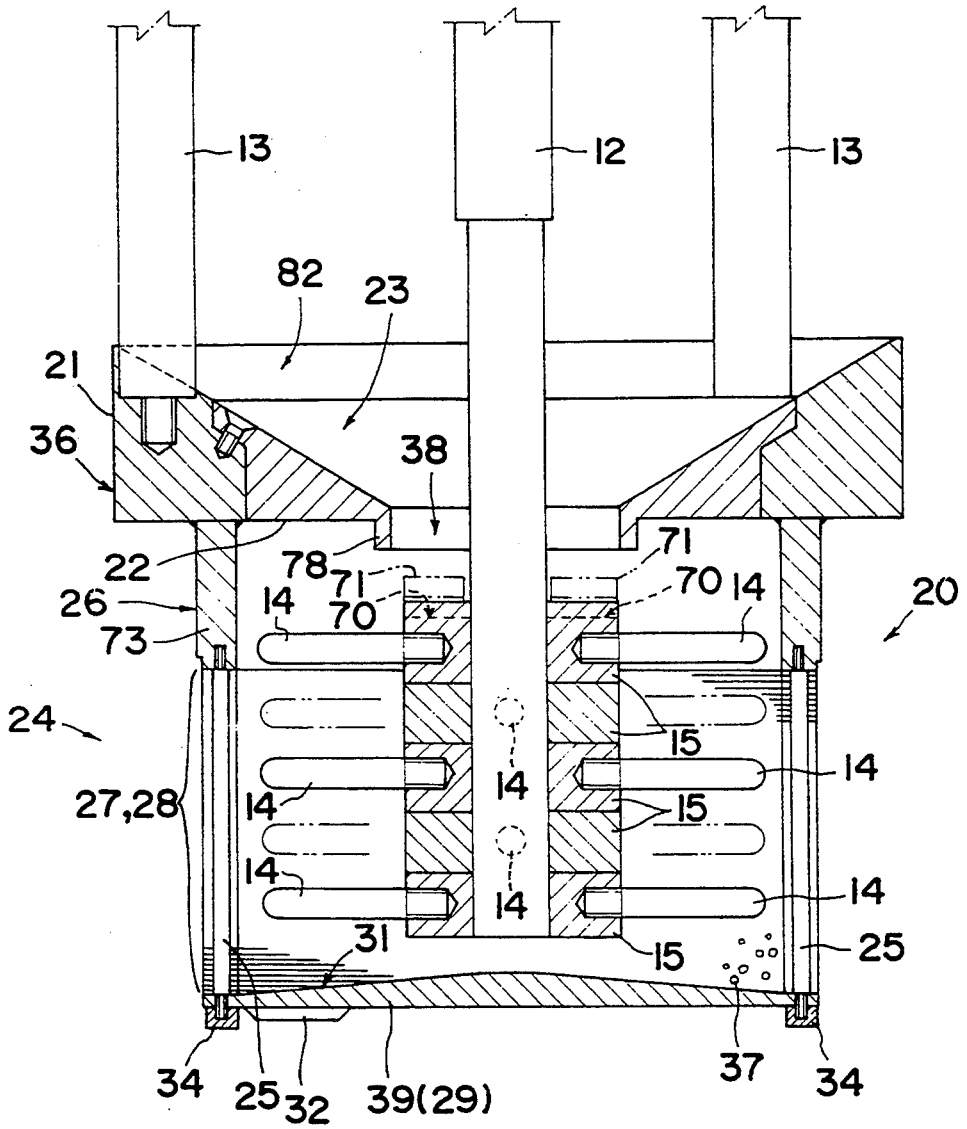
FIG. 6 is a view illustrating a portion of a basket in detail.
Figure 7:
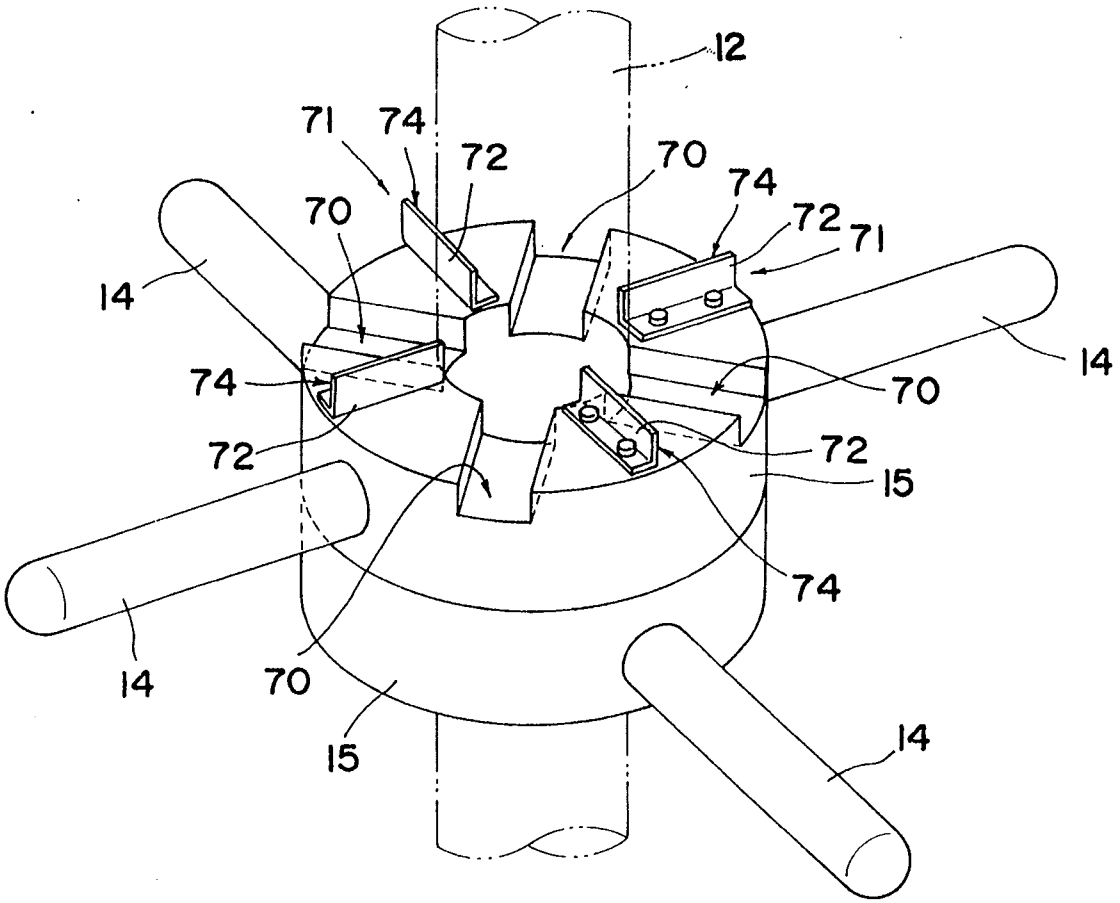
FIG. 7 is a perspective view of an embodiment provided with grooves and vanes.

As shown in FIGS. 6 and 7, in the support member 15 are formed crossing grooves 70 with the main shaft 12 as a center. The grooves 70 are formed for generating a whirling current from the opening 38 to assist the flow of the blend 65 and the dispersing media 37 into the basket 20 through the opening 38 to which the support member 15 is opposed. The grooves 70 are formed in a square shape running into the support member 15 at right angles from the surface of the support member 15, and extending from the outer peripheral edge of the main shaft 12 or from the vicinity thereof to the outer peripheral edge of the support member 15.

It is further allowable to provide a stirrer means which has vanes 71 in addition to the grooves 70 or instead of the grooves 70 as shown therein. The diagramed embodiment is equipped with L-shaped angles 74 having vane pieces 72 erected upright with the lengthwise directions between the crossing grooves 70 as a radial direction. This helps increase the whirling current from the opening 38 into the basket 20 being assisted by the grooves 70.

The above grooves 70 and vanes 71 are not limited to those of straight lines but may be formed in straight lines in the direction of diameter of the support member 15, or may be formed or mounted in any plurality of numbers equally dividing the circumference of the support member 15. When the blend 65 has a low viscosity, the grooves 70 or the vanes 71 may be formed in the direction of diameter only of the support member 15. When the blend 65 has a high viscosity, it is recommended to provide the vanes 71 at positions equally dividing the circumference of the support member 16 into six. This makes it possible to prevent the blend 65 from staying among the vanes 71 when the support member 15 is rotated at a speed as high as about 1600 rpm.

In this sense and by taking the viscosity and the like of the blend 65 into consideration, insertion holes of a small diameter may be perforated in the vanes 71 in the lengthwise direction to prevent the blend 65 from staying among the vanes 71.

Driving Means

Reference numeral 11 denotes a driving means. Two motors 41 and 48 are provided on the upper surface of the apparatus body 10, and rotational forces of the motors 41 and 48 are transmitted via transmission means such as V-belts or the like that are not shown to rotate the main shaft 12 and the sub-shaft 46. The motors 12 and 48 are, respectively, equipped with speed-change means that are not shown to adjust the speed of revolution.

The driving means 11 should be so constituted that the motor 48 is driven to rotate the secondary vanes 47 of the sub-shaft 46 during the premixing, and the motors 12 and 48 are driven to rotate the primary vanes 14 and the secondary vanes 47 during the step of dispersion from the standpoint of premixing action, dispersion and economy.

Another example of the driving means 11 for separately rotating the main shaft 12 and the sub-shaft 46 is such that the main shaft 12 and the sub-shaft 46 are rotated by a single motor via a V-belt, the rotary shaft of the motor is provided with a switching means such as an electromagnetic clutch or the like, and this switching means is so operated that the secondary vanes 47 only are rotated during the step of premixing and both the primary vanes 14 and the secondary vanes 47 are simultaneously rotated during the step of dispersion.

Basket

Figure 5:
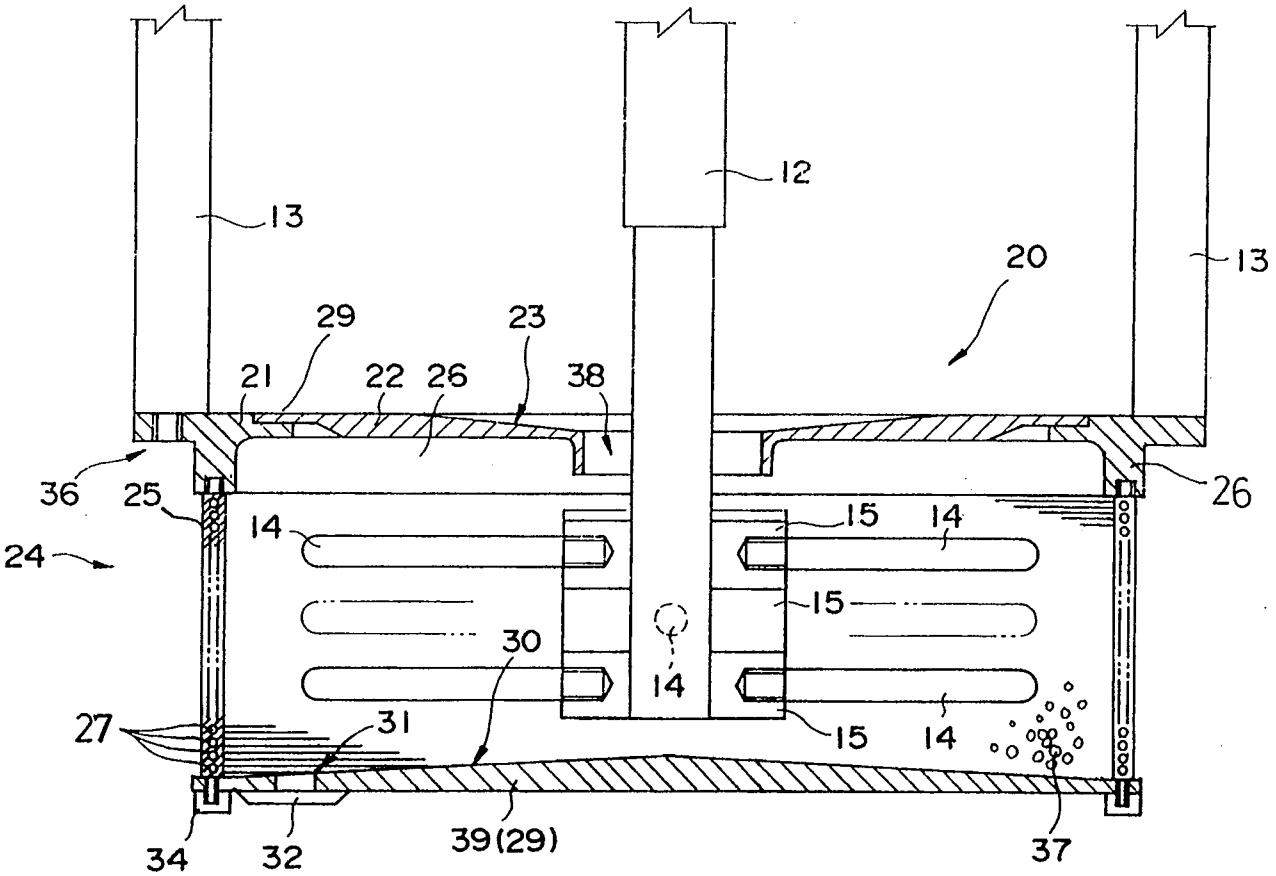
FIG. 5 is a view illustrating a portion thereof in detail.

Reference numeral 20 denotes a basket. Though there is no particular limitation in its shape, the basket 20 in this embodiment has a flat cylindrical shape having a diameter of about 800 mm and a depth of about 200 mm, and is secured to the apparatus body 10 (FIG. 1) using four rods 13 that downwardly extend from the end of the apparatus body 10 nearly in parallel with the main shaft 12 and that are coupled to a top flange 21 of a sleeve 36 that protrudes in the circumferential direction of the basket at the upper portion of the side wall 24 of the basket 20. As shown in FIG. 5, furthermore, the primary vanes 14 are attached at the end of the main shaft 12 via the support member 15 to rotate on a plane nearly at the center in the basket 20. Dispersion media 37 such as glass balls, steel balls, ceramic balls and zirconia balls are further contained in the basket 20. Details of the basket 20 will be described later.

Tank and Washing Tank

Referring to FIG. 2, two tanks 60 and one washing tank 170 are arranged surrounding the elevator device 50 at such positions that the basket 20 and the secondary vanes 47 of the apparatus body 10 can be inserted therein or removed therefrom, the elevator device 50 being buried in the floor or being installed on the underlying layer beneath the floor (FIG. 1).

The tank 60 is the one for effecting the dispersion and has a diameter of about 1500 mm which is slightly less than two folds of the diameter of the basket 20, a depth of about 700 mm and has a capacity of about 3000 liters. The washing tank 170 has a diameter of about 1300 mm, a depth of about 700 mm and a capacity of about 2000 liters.

The tanks 60 are arranged as described below.

In FIG. 2, the basket 20 is disposed at a position deviated from the center of the tank 60. A portion of the outer periphery of the basket 20 is disposed near the inner peripheral wall of the tank 60 of the side closest to the cylinder 53. A hopper portion 34 for throwing starting materials of the blend 65 is formed on the opposite side of the inner peripheral wall of the tank 60. The sub-shaft 46 is located on one side of the inner peripheral wall of the tank 60 which is opposite to the outer periphery of the basket 20 but is close thereto, and the secondary vanes 47 rotate being located in the hopper portion 34 near the center of the tank 60 under the basket 20 and close to the bottom wall of the tank 60 (FIG. 1).

That is, in FIG. 2, the basket 20 having a diameter of about 800 mm is disposed at a position deviated from the center of the tank 60 which has a diameter of about 1500 mm maintaining a gap of 50 mm between a point A on the circumference of the basket 20 and a point D on one side of the inner peripheral wall of the tank 60. A point B on the circumference of the basket 20 which is opposite to the point A of the basket 20 is located at a distance of 200 mm from the center C of the tank 60. Therefore, the distance is 450 mm between the point B on the circumference of the basket 20 and a point E on the other side of the inner peripheral wall of the tank 60, and there is formed a relatively large hopper portion 34 in the tank 60. The sub-shaft 46 is disposed in the hopper portion 34 near the point B on the circumference of the basket 20 which is closest to the center C of the tank 60.

When the tank 60 has a diameter which is two or more times as great as the diameter of the basket 20, therefore, the sub-shaft 46 can be disposed nearly at the center C of the tank 60, such that the blend 65 in the tank 60 can be stirred by the secondary vanes 47 maintaining an increased efficiency. According to this embodiment, however, the diameter of the tank 60 is selected to be slightly less than two folds of the diameter of the basket 20, so that the dispersing efficiency in the basket 20 is least impaired. By providing the sub-shaft 46 and the basket 20 close to each other, however, the stirring efficiency and dispersing efficiency can be improved. It is therefore desired that the diameter of the tank 60 is selected to be two or more times as great as the diameter of the basket 20.

The bottom wall is downwardly curved so that the liquid in the tank 60 easily flows out. At the center of the bottom wall are further provided a ball valve 67 for taking out the liquid of blend 65 and a drain port 69 for draining the washing solution after the tank 60 is washed. At an upper portion on the side wall of the tank 60 is provided a water-feeding port 68 for feeding the washing water or washing solution for washing the tank 60.

The washing tank 170 needs not be equipped with the hopper portion 34 like that of the tank 60. With the gap between the point A on the circumference of the basket 20 and the inner peripheral wall on one side of the washing tank 170 being maintained like that of the case of the tank 60, however, the secondary vanes 47 can be brought close to the center of the washing tank 17, so that the secondary vanes 47 produce good stirring effect and enhanced washing effect.

As shown in FIG. 1, furthermore, the washing tank 170 has a bottom which is tapered so that the washing solution in the tank can be easily drained, and has a ball valve 66 at the lowermost end thereof to drain the solution.

Top Cover

Figure 8A:
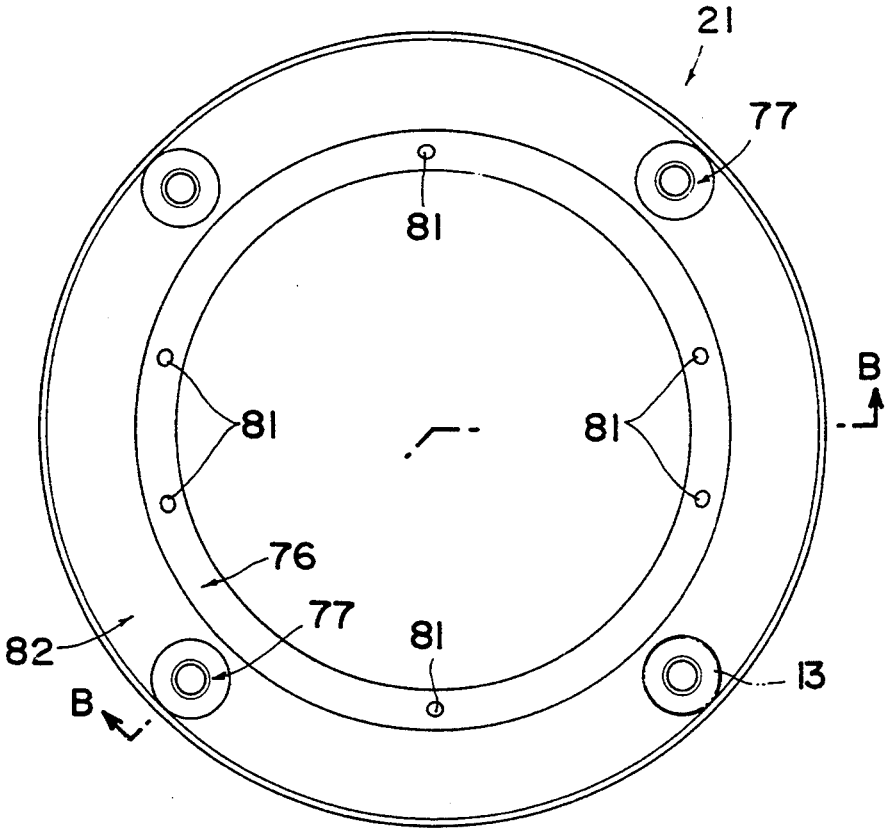
FIG. 8(A) is a plan view illustrating a top flange.
Figure 8B:
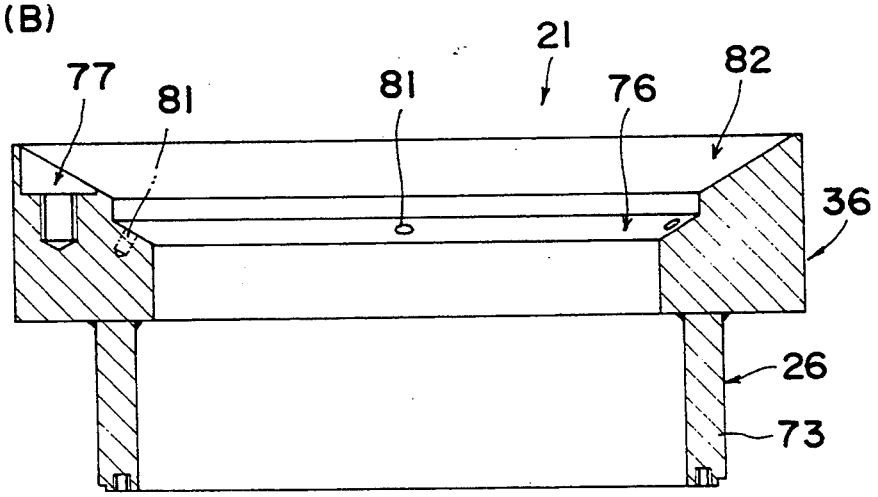
FIG. 8(B) is a sectional view taken along the line B—B in FIG. 8(A)

With reference to FIGS. 8(A) and 8(B), the top flange 21 according to an embodiment of the present invention is constituted by a base portion 73 which has a flat annular surface and forms a side wall 26 coupled to poles 25, and a sleeve 36 that is integrally formed together with the base portion 73 or that is secured thereto by welding or the like.

The sleeve 36 is made of a pure metallic material of nearly a trapezoidal shape having a stepped mounting portion 76 with holes 81 for mounting on the surface thereof a top cover 22 that will be described later, the periphery in cross section of the sleeve being downwardly inclined toward the center thereof at an angle of nearly 30 degrees. In the inclined surface 82 on the stepped mounting portion 76 are formed threaded portions 77 into which the lower ends of the four rods 13 will be screwed.

Therefore, the aforementioned slits 35 are formed in the whole side wall 24 except the side wall 26.

A top cover 22 is secured to the top flange 21 on the upper surface of the basket 20, the top cover 22 having an opening 38 at the central portion thereof for inserting the main shaft 12 therein and for guiding the liquid blend 65 containing solid matters such as paints, inks and like pigments in the tank 60 into the basket 20, and further having a tapered guide surface 23 for guiding the blend 65 into the opening 38.

Figure 9A:
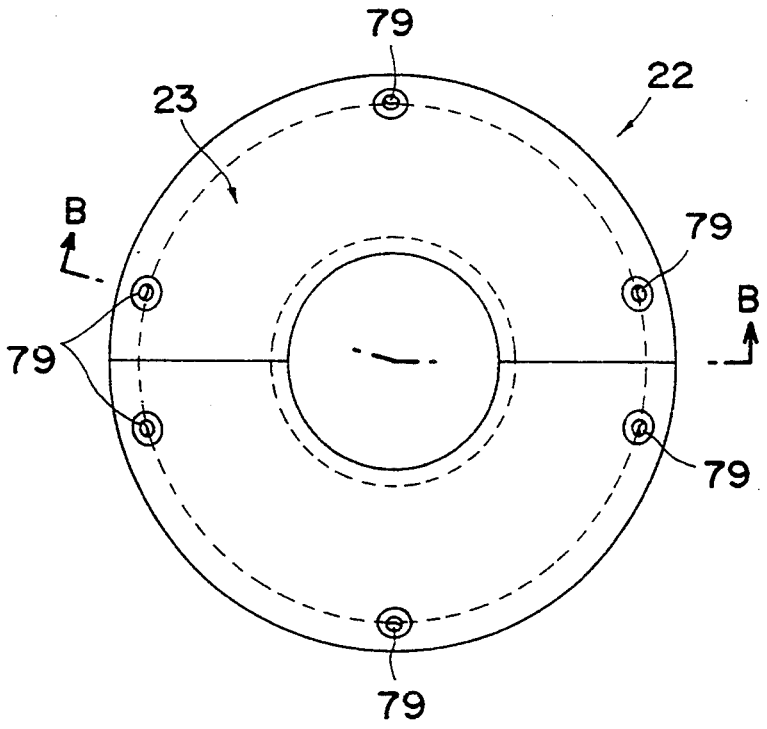
FIG. 9(A) is a plan view illustrating a top cover.
Figure 9B:
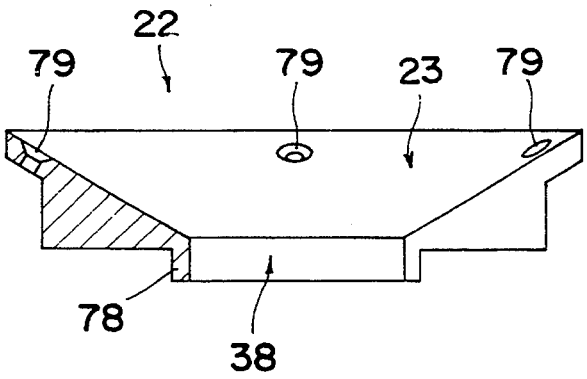
FIG. 9(B) is a sectional view taken along the line B—B in FIG. 9(A) which illustrates the top cover.

As shown in FIGS. 9(A) and (9B), furthermore, the top cover 22 has an inclined surface of nearly a triangular shape in cross section of which the periphery in cross section is downwardly inclined toward the center thereof at an angle of about 30 degrees to correspond to the top flange 21, and further has a guide piece 78 that downwardly extends from the outer peripheral edge of the opening 38 at the center. The angle of inclination can be selected over a range of from about 20 to about 40 degrees depending upon the tank, capacity of the basket, and number of revolutions of the primary vanes.

The top cover 22 is split into two in the direction of diameter. Flat-head screws are inserted in the holes 79 formed at six places in the outer periphery thereof, and are screwed into the threaded holes 81 formed in the stepped mounting portion 76 of the top flange 21, so that the surface of the top cover 22 and the surface of the inclined surface 82 on the stepped mounting portion 76 meet each other.

Moreover, the sleeve 36 is so provided as to permit the outer peripheral surface of the top flange 21 positioned at an upper portion of the side wall 24 of the basket 20 to protrude beyond the outer peripheral surface of the side wall 24 as shown in FIG. 6, in order to increase the convection on the lower side and to enhance the dispersing effect.

A bottom wall 29 is provided on the lower surface of the side wall 24 at the bottom of the basket 20, the bottom wall 29 being a blind bottom plate 39 without having slits or holes of a net of fine mesh that permit the flow of the blend 65.

The inner surface of the blind bottom plate 39 is downwardly tapered from the center thereof toward the side wall 24, and a hole 31 is formed in the blind bottom plate 39 on the side of the side wall 24 and is usually closed with a plug 32.

Portions of the Basket

Referring to FIG. 5, the basket 20 has the side wall 26 of a diameter of 800 mm that forms part of the side wall 24 and downwardly protrude from the lower surface of the top flange 21 that is secured to the lower ends of the rods 13. From the lower end of the side wall 26 are downwardly protruded poles 25 of a square shape of a number of 24 along the circumferential direction of the side wall maintaining an equal distance of about 100 mm. That is, the poles 25 have threaded portions formed at the upper ends that are screwed into the lower end surface of the side wall 26.

Figure 10:
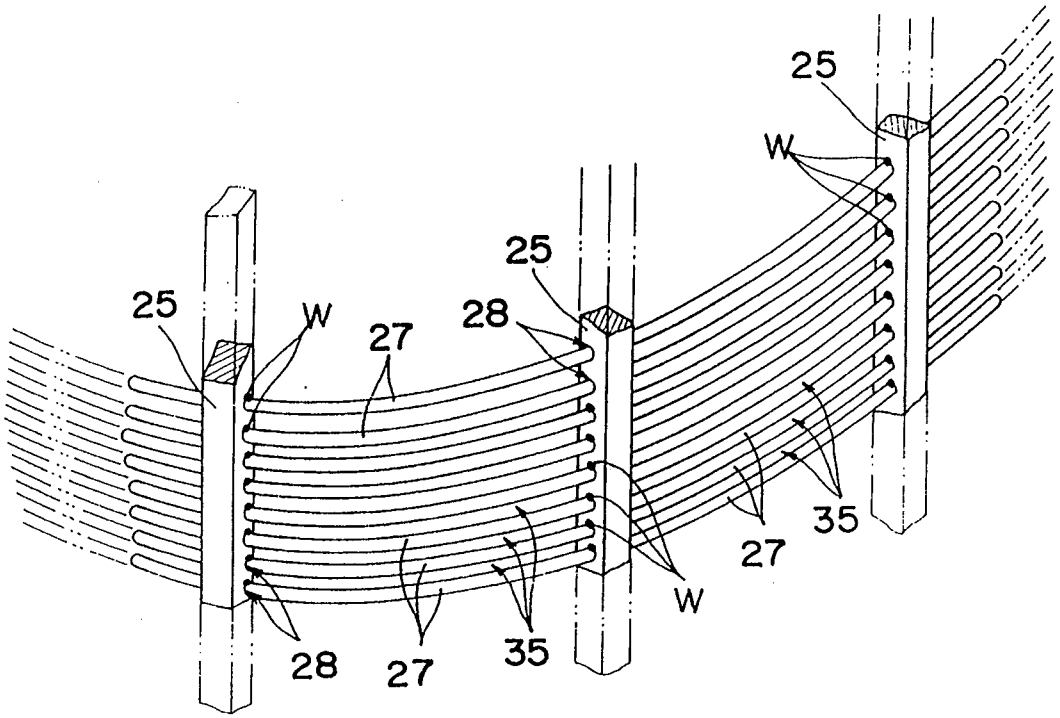
FIG. 10 is a perspective view illustrating a portion of the side wall of the basket.
Figure 11:
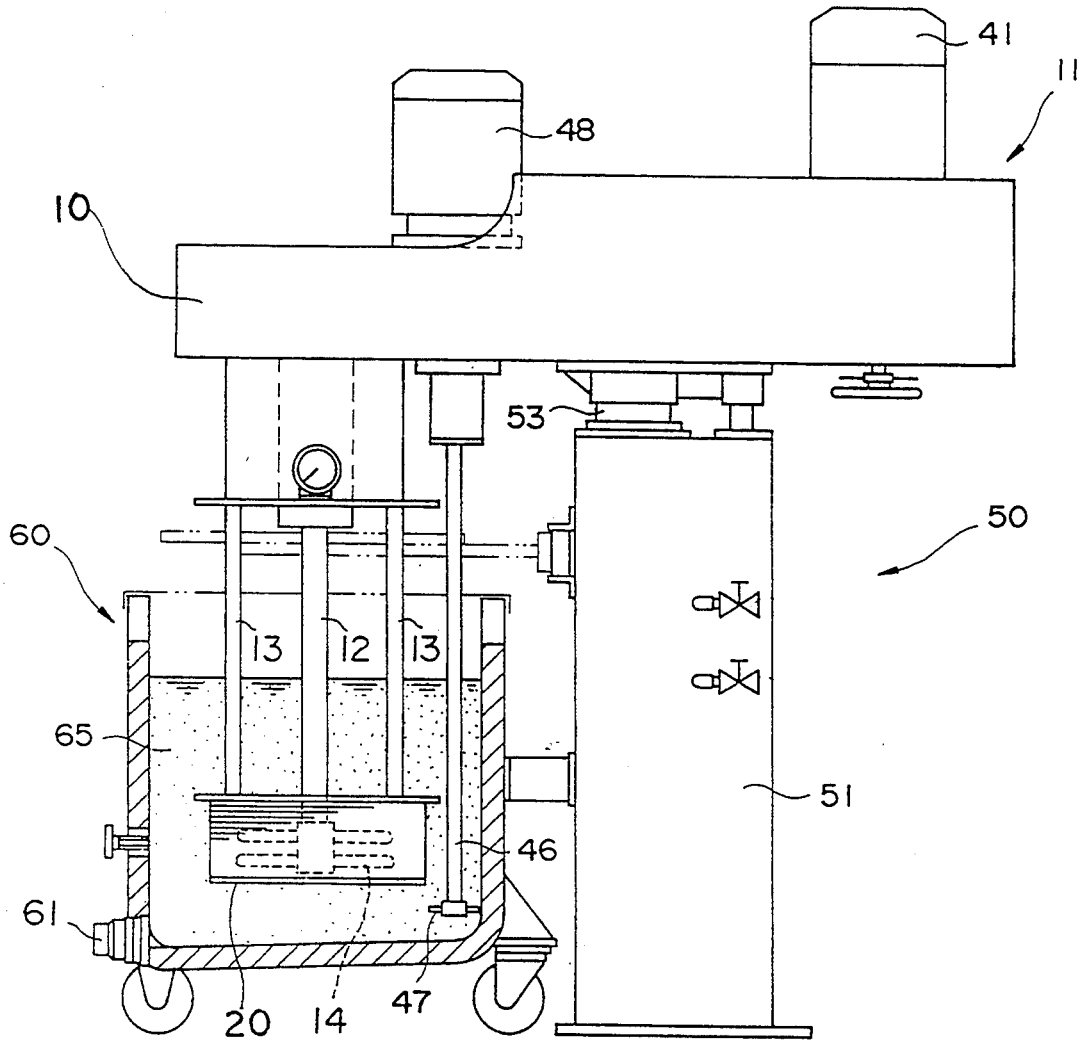
FIG. 11 PRIOR ART
FIG. 11 is a general view of a conventional dispersing apparatus showing part of it in cross section.

Then, as shown in FIG. 10, each pole 25 is provided with many wire holes 28 in the surface facing the circumferential direction of the side wall in the up-and-down direction maintaining a gap of about 0.8 mm, so that there can be inserted wires 27 of a diameter of 4 mm and having a circular shape in cross section in the horizontal direction. Wires 27 of a length of one turn along the circumferential direction of the side wall are inserted in the corresponding wire holes 28. Both ends of the wire 27 are abut together in an endless manner in the wire hole 28 of a pole 25. The ends are secured by being spot-welded as designated at W to the end surface of the wire hole 28 of the pole 25. The spot-welding W can be effected at any wire hole 28.

As described above, the wires 27 of a length of one turn along the circumferential direction of the side wall are inserted in each of the wire holes 28 in the up-and-down direction. Therefore, very small gaps of 0.8 mm are formed among the wires 27, 27 facing each other in the up-and-down direction, slits 35 are formed in many number by the wires 27, 27 facing in the up-and-down direction and by the poles 25, 25 facing in the circumferential direction of the side wall 24, and these slits 35 are formed in the whole periphery of the side wall 24.

Here, the very small gap of the slits 35 can be selected to any desired value depending upon the dispersion condition of the grains of the solid matters, and the gap among the neighboring poles 25, 25 is not limited to 100 mm mentioned above but may be suitably changed depending upon the strength of the wires 27.

As shown in FIG. 10, furthermore, the wires 27 may be formed in a curved shape using rigid wires such as piano wires that will not be deformed by the dispersing media 37. Or, the wires 27 may be inserted in the wire holes 28 of twenty-four poles 25, and the ends of the wires 27 may be pulled tight so that the wires 27 run straight among the neighboring poles 25, 25 and, then, the ends of the wires 27 are coupled together by welding.

It is further allowable that the wires 27 are highly rigid straight or curved wires that will not be almost deformed by the collision of the dispersing media 37, the wires 27 having a length that spans across the neighboring two poles 25, 25, and the ends of the wires 27 being inserted in the corresponding wire holes 27 of the poles 25, 25. Here, when the wire holes 28 are those that penetrate through the poles 25 into both side surfaces, the ends of the neighboring wires 27, 27 inserted in the wire hole 28 from both sides of the pole 25 may come into contact with each other inside the wire hole 28 to affect one another. When the wire holes 28 are not penetrating through the poles 25 into both side surfaces, on the other hand, the ends of the wires 27 do not affect the other ones, which is rather desirable than when the wire holes 28 are penetrating therethrough.

Moreover, it is allowable that the wires 27 have a length of one-half or one-third of a turn in the circumferential direction of the side wall, and these wires 27 are inserted in the wire holes 28 in the circumferential direction of the side wall.

As described above, there is no particular limitation in the structure for mounting the wires 27 on the poles 25. Reference numeral 39 denotes the blind bottom plate which forms the bottom wall of the basket 20 and is fastened by nuts 34 to the threaded portions formed at the lower ends of the poles 25. The inner surface of the blind bottom plate 39 is downwardly tapered from the center thereof toward the periphery of the side wall, and the hole 31 is formed therein near the side wall 24 and is usually closed by a plug 32 of the dispersing media. When the basket 20 is pulled up from the blend 65 in the tank 60, therefore, the liquid drains well since the inner surface of the blind bottom plate 39 is tapered, and the blend 65 in the basket 20 is not wasted.

Step of Premixing

First, the premixing is effected in the dispersing apparatus.

In FIG. 2, the cylinder 53 is actuated by the hydraulic cylinder of the elevator device 50 to lower the apparatus body 10, so that the basket 20 and the secondary vanes 47 are inserted in the tank 60. Starting materials of the blend 65 such as a resin, a solvent and the like are thrown from the hopper portion 34 of the tank 60 to a about one-third the depth of the tank 60 (FIG. 1). The sub-shaft 46 is driven by the motor 48 to rotate the secondary vanes 47 and to stir the resin, solvent and the like. In this case, the motor 41 has not been energized, and the primary vanes 14 are not rotating. Then, the pigment is thrown little by little into the tank 60 from the hopper portion 34 under the condition where the starting materials such as the resin, solvent and the like are being stirred. Since the secondary vanes 47 are rotating near the center of the tank 60, the blend 65 containing the resin, solvent, pigment, etc. is efficiently premixed into a paste-like mixture.

Step of Dispersion

After the pigment is thrown in whole amounts, the solvent is then thrown to dilute the blend 65. The secondary vanes 47 continue to rotate. The main shaft 12 is then driven by the motor 41 to rotate the primary vanes 14, and the step of dispersion is carried out.

The blend 65 under the basket 20 is raised and is efficiently stirred by the convection produced by the rotation of the secondary vanes 47 located near the center of the tank 60, whereas the blend 65 in the basket 20 is stirred by the rotation of the primary vanes 14, and the solid matters in the blend 65 are dispersed into fine grains due to shearing stress between the dispersing media 37 contained in the basket 20 and the solid matters in the blend 65. The bottom wall of the basket 20 is a blind bottom plate 39, and grains of solid matters in the blend 65 that are subject to be precipitated are dispersed in the basket 20 without falling down from the basket.

Fine grains in the basket 20 flow out of the side wall 24 passing through very fine gaps of numerous slits 35 in the side wall 24 due to the centrifugal force produced by the rotation of the primary vanes 14. Grains which are larger than the very fine gaps of the slits 35 stay in the basket 20 and are further finely dispersed inside the basket 20.

Very fine gaps of the slits 35 are formed among points of circumferences of the wires 27, 27 that have a circular shape in cross section and that are opposed to one another in the up- and-down direction. Therefore, grains of sizes close to very fine gaps of the slits 35 come into point-contact with the upper and lower wires 27, 27, and are never stuck in the slits 35. Accordingly, the slits 35 are not clogged by the grains of solid matters, and the dispersion efficiency does not decrease.

The blend 65 that has flown out through the side wall 24 is efficiently pushed up beyond the basket 20 due to the convection produced by the secondary vanes 47 rotating near the center of the tank 60 under the basket 20, and flows again into the basket 20 and is dispersed more finely.

Due to the rotation of the primary vanes 14 attached to the main shaft 12 and both or one of the grooves 70 and the vanes 71 formed in the support member 15, the blend 65 in the tank 60 flows into the basket 20 through the opening 38 in the top cover 22 in the upper surface of the basket 20, and solid matters in the blend 65 are finely dispersed due to shearing stress between the dispersing media 37 and the blend 65 being stirred by the rotation of the primary vanes 14 in the basket 20. The fluid consisting of finely pulverized grains of solid matters and liquid flows out of the basket 20 passing through pores 35 of slits formed in the side wall 24 due to the centrifugal force produced by the rotation of the primary vanes 14. Therefore, the blend 65 over the basket 20 flows into the basket 20 being guided through the opening 38 along the tapered guide surface 23 provided on the upper surface of the top cover 22.

In particular, rotation of both or either one of the grooves 70 or vanes 71 on the support member 15 whirls the blend 65 between the grooves 70 or the vanes 71 and the opening 38 and further whirls the blend on the opening 38. Therefore, the blend 65 is whirled even on the inclined surface formed by the inclined surface 82 of the top flange 21 and by the guide surface 23 of the top cover 22. The whirling current causes the blend 65 on the guide surface 23 of the top flange 21 and on the above inclined surface to flow into the basket 20 through the opening 38, and promotes the convection of the blend 65 in the tank 60 and in the basket 20.

The dispersing media 37 in the basket 20 may fly over through the opening 38. Due to the above-mentioned downward whirling current, however, the dispersing media 37 fall on the inclined surfaces of the top flange 21 and the top cover 22, and are introduced again into the basket 20 through the opening 38 due to quick rotation of the primary vanes 14. Thus, the dispersing media 37 do not fly out of the basket 20 and do not fall on the bottom of the tank 60.

The blend 65 that flew out of the basket 20 passing through the slits 35 is pushed up by the convection produced by the whirling current, and is introduced again into the basket 20.

Due to a large sucking force produced by the grooves 70 or the vanes 71, furthermore, the blend 65 flows in large amounts into the basket 20, and convection of the blend 65 becomes active in the tank 60 and in the basket 20. Therefore, the secondary vanes need not be used in the step of dispersion.

After the step of dispersion is finished, the apparatus body 10 is raised to remove the basket 20 and the secondary vanes 47 out of the tank 60. Then, the apparatus body 10 is turned in a horizontal direction to the washing tank 170 as indicated by a two-dot chain line in FIG. 2, and is lowered so that the basket 20 and the secondary vanes 47 are submerged in the washing solution in the washing tank 170. The primary vanes 14 and the secondary vanes 47 are then rotated. As the primary vanes 14 are rotated, the dispersing media 37 and the primary vanes 14 in the basket 20 are washed with the washing solution. Moreover, the wires 27 are washed as the washing solution in the basket 20 flows out of the side wall 24 passing through the slits 35 being driven by the centrifugal force. As mentioned earlier, the wires 27 have a circular shape in cross section and come into point-contact with the grains of the solid matters, and can be easily washed since the grains of the solid matters do not stick to very fine gaps of the slits 35.

Furthermore, rotation of the secondary vanes 47 produces convection of the washing solution in the washing tank 170, and the surfaces of the rods 13 and the basket 20 are washed by the convection. The main shaft 12 and the sub-shaft 46 are quickly washed since they rotate in the washing solution.

After the step of washing the dispersing apparatus is finished, the apparatus body 10 is moved up to remove such members as the basket 20 and the secondary vanes 47 from the washing tank 170. Then, as indicated by the two-dot chain line in FIG. 2, the apparatus body 10 is turned in the horizontal direction to another tank 60 which is different from the tank 60 used in the above-mentioned step of dispersion. The apparatus body 10 is then lowered in order to premix and disperse another kind of paint in the same manner as the above-mentioned step of dispersion.

While carrying out the washing operation as well as the premixing and dispersion in another tank 60, the ball valve 67 at the bottom wall of the first tank 60 is opened, so that the blend 65 for which the step of dispersion has been finished is transferred to the subsequent steps of dissolution, color adjustment, filtration and canning. After the blend 65 is all removed, the washing solution is poured into the empty tank 60 from the water-feeding port 68 to wash the interior of the tank 60. After washing, the water-draining port 69 is opened to drain the washing solution. The thus washed tank 60 is used for premixing and dispersing a further kind of the blend in the next time.

As described above, the blends of different kinds are efficiently premixed and dispersed by alternatingly using two tanks 60 and one washing tank 170.

According to the present invention as described above, a solvent and a varnish such as a paint, an ink, etc. are thrown into the tank from the hopper portion, the solution of solvent, varnish, etc. is stirred by rotating the secondary vanes, and solid matters such as pigments and the like are thrown little by little from the hopper portion to carry out the premixing efficiently.

Described below are the results of comparing performance of the dispersing apparatus of the present invention constituted as described above with performance of a conventional apparatus (Comparative Example 1) which has differences from the present invention as described below.

| | Apparatus of the invention | Comp. Ex. 1 |
|---|---|---|
| Pores | In the side wall only, no pores in the bottom of the basket | In the whole basket (side wall + bottom wall) |
| Sleeve | Protrudes in the outer circumferential direction of the basket | none |
| Convection into the basket | Supported by the sub-shaft in the blend outside the basket | Supported by the main shaft that penetrates through the basket and under the basket |

The dispersing apparatuses used for the test possessed the following ratings.

| | Comp. Ex. 1 | Apparatus of the invention |
|---|---|---|
| Feeding capacity (L) | 15 | 44 |
| Milling capacity (L) | 1.1 | 4.1 |
| Motor (KW) | 2.2 | 7.5 |
| Number of revolutions (rpm) | 1500 | 1500 |

Testing Example 1
[Blending Conditions]

| | |
|---|---|
| Alkyd varnish | 44 |
| Xylol | 13.5 |
| Swasol | 13.5 |
| Cyanine Blue | 29 |
| (Total) | 100 |
| P/V = 0.4 | |
| VS % = 40 | |
| Viscosity 78 Ku | |

[Dispersing Conditions]

Apparatus of the

-continued

| | Comp. Ex. 1 | invention |
|---|---|---|
| Peripheral speed (m/s) | 9 | 9 |
| Medium | glass having a grain size of 1.9 mm | glass having a grain size of 1.9 mm |
| Medium filling rate (%) | 75 | 75 |
| Amount of paste fed (L) | 15 | 44 |

Graph 1 shows the measured results of the grain size of the blend (paste) with the passage of the dispersion time by using, as a sample and under the above-mentioned conditions, the paste of the Cyanine Blue prepared under the above-mentioned blending conditions.

As will be obvious from the results shown in Table 1, the dispersing apparatus of the present invention makes it possible to finely disperse the solid matters within a period of time which is shorter than that of Comparative Example 1.

The blends obtained in the above testing were further tested for their tinting strength with the passage of the dispersion time of the blends. The results were as shown in Graph 2 and in Table 1.

Here, the tinting strength (K/S) is a unit of reflection-/absorption of light as measured by a spectrophotometer. The light is more reflected and more vivid color is exhibited with an increase in this value.

TABLE 1

Relationship between the dispersion time and the tinting force/grain size distribution.

| | Dispersion time (min.) | Tinting force (K/S) | Average grain size (microns) |
|---|---|---|---|
| Comp. Ex. 1 | 420 | 1.35 | 0.366 |
| Apparatus of the invention | 240 | 1.37 | 0.269 |

As will be obvious from the above results, the apparatus of the present invention makes it possible to obtain a blend having a tinting force larger than, and within a period of time shorter than, those of Comparative Example 1.

Testing Example 2
[Blending Conditions]

| | |
|---|---|
| Alkyd varnish | 69 |
| Xylol | 24 |
| Carbon beads | 7 |
| (Total) | 100 |
| P/V = 0.07 | |
| VS % = 45 | |
| Viscosity 95 Ku | |

[Dispersing Conditions]

| | Com. Ex. 1 | Apparatus of the invention |
|---|---|---|
| Peripheral speed (m/s) | 9 | 9 |
| Dispersing medium | glass beads having a grain size of 3 mm | glass beads having a grain size of 3 mm |
| Medium charging rate (%) | 75 | 75 |
| Amount of paste fed (L) | 15 | 44 |

By using the paste of carbon beads blended under the above-mentioned conditions as a paste, the grain size of the paste was measured with the passage of time under the above-mentioned conditions. In the dispersing apparatus of Comparative Example 1, however, the carbon beads could not be dispersed because the pores of the basket were clogged.

By using the apparatus of the present invention, there were obtained a dispersion rate, a tinting force, grain size distribution, and dispersion effect, which were superior to those of Comparative Example 1. Thus, the apparatus of the present invention makes it possible to disperse the carbon beads.

Tabulated below are the effect of dispersion and time using the dispersing apparatus of Comparative Example 1 in comparison with those of the dispersing apparatus of the invention that has a blind bottom wall and has pores in the side wall only, which are the differences from Comparative Example 1.

[Table comparing the effects of dispersion]

| | Apparatus with blind bottom wall | | Comparative Example 1 | |
|---|---|---|---|---|
| Material | Dispersion time hr., min.. | Kneading μ | Dispersion time hr., min | Kneading μ |
| — | | | | |
| Stoving white | 0.20 | 10 | 0.50 | 10 |
| Blue | 1.10 | 13 | 2.00 | 10 |
| Green | 1.10 | 13 | 2.10 | 10 |
| Maroon | 1.20 | 10 | 2.30 | 10 |
| Red | 1.00 | 15 | 2.30 | 10 |
| Vermilion | 1.10 | 15 | poorly dispersed | |
| Red iron oxide | 1.00 | 10 | poorly dispersed | |
| white | | | | |
| Acryl | 0.25 | 10 | 1.00 | 10 |
| Blue | 1.30 | 10 | 2.10 | 10 |
| Green | 1.30 | 10 | 3.00 | 10 |
| Oxide yellow | 1.30 | 10 | 1.50 | 10 |
| Red iron oxide | 1.30 | 10 | poorly dispersed | |
| Urethane white | 0.20 | 10 | 1.10 | 10 |
| Blue | 1.00 | 10 | 2.30 | 10 |
| Bordeaux | 1.30 | 10 | 2.30 | 10 |
| Kermes | 1.30 | 10 | 2.30 | 10 |
| Red | 1.30 | 10 | 2.30 | 10 |
| 5G | 1.20 | 10 | 2.30 | 10 |
| Green | 1.30 | 10 | 2.30 | 10 |

According to the present invention, the solvent such as a paint or an ink, varnish, etc. are thrown into the tank from the hopper portion, and solid matters such as pigment and the like are thrown little by little into the liquid of the solvent and varnish while stirring it by rotating the secondary vanes, in order to premix them efficiently.

The present invention which is equipped with the hopper portion makes it possible to continuously carry out the premixing and the dispersion without moving the tank and, hence, makes it possible to efficiently carry out the dispersion operation.

With the premixing and dispersion being carried out without moving the tank, the present invention makes it possible to employ a tank having a capacity of as large as 1000 liters or more and to disperse the blend in large amounts.

The invention employs a driving means which drives the sub-shaft only during the premixing and drives both the sub-shaft and the main shaft during the step of dispersion. That is, the premixing is carried out using the secondary vanes and the dispersion is carried out using both the primary vanes and the secondary vanes; i.e., the premixing and the dispersion are efficiently carried out.

The invention employs a tank having a diameter which is about two times or more as great as the diameter of the basket, enabling the hopper portion to be provided in the tank. Therefore, the dispersion efficiency is not impaired by the basket, and improved stirring efficiency is accomplished by the secondary vanes.

According to the present invention, the premixing and dispersion are carried out in one tank and, then, the apparatus body is raised, turned to the washing tank and is lowered so that the basket and the secondary vanes are submerged in the washing solution in the washing tank. The primary vanes and the secondary vanes are then rotated to efficiently wash the dispersing apparatus such as basket, secondary vanes and the like.

According to the present invention, furthermore, the premixing and dispersion are carried out in another tank immediately after the dispersing apparatus that includes the basket and the secondary vanes is washed in the washing tank. During this period, furthermore, the tank used in the dispersing operation is washed. By alternatingly using a plurality of tanks, therefore, the blends of various kinds can be premixed and dispersed continuously and efficiently.

According to the present invention in which a whirling current or a vortex current is produced in the basket and in the tank, the blend near the Opening is caused to flow again into the basket from the inclined surface that is downwardly inclined toward the center of the opening of the top cover together with the dispersing media that have flown from the basket, and the convection of the blend is promoted in the tank, enabling the stirring and dispersion to be effectively carried out.

The step of dispersion may be carried out without rotating the secondary vanes.

In the present invention in which slits are formed by wires, furthermore, solid matters such as pigments in the blend do not stick to the slits. Therefore, the dispersion efficiency is not lost since the slits are not clogged, and there is provided a dispersing apparatus having a basket that can be easily washed.

Even in case the side wall is hit by the dispersing media contained in the basket due to the centrifugal force. produced by the turn of the primary vanes causing the wires of the side wall to be deformed or worn out, such wires according to the present invention can be partly replaced by new ones with ease.

Thus, the broadest claims that follow are not directed to a machine that is configured in a specific way. Instead, the broadest claims are intended to protect the heart or essence of this breakthrough invention. This invention is clearly new and useful. Moreover, it was not obvious to those of ordinary skill in the art at the time it was made, in view of the prior art when considered as a whole.

Moreover, in view of the revolutionary nature of this invention, it is clearly a pioneering invention. As such, the claims that follow are entitled to very broad interpretation so as to protect the heart of this invention, as a matter of law.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. In a dispersing apparatus wherein a basket containing dispersing media is secured to an apparatus body that can be moved up and down by coupling rods to a sleeve that is formed in a protruding manner in a circumferential direction at an upper part of the side wall of the basket, and the apparatus body is provided with a main shaft and a sub-shaft that are rotated by a driving means, the main shaft and the sub-shaft being provided with primary vanes and secondary vanes, respectively, so as to rotate in the basket and under the basket to disperse a liquid blend that contains solid matters such as paints, inks and like pigments, the improvement wherein the center of said basket is located at a position deviated from the center of the tank, a hopper portion for throwing the starting materials of said blend is formed between the outer periphery of the basket located near the inner peripheral wall on one side of the tank and the inner peripheral wall on the other side of the tank, and said secondary vanes are disposed to rotate in said hopper portion near the center of the tank under the basket.

2. A dispersing apparatus according to claim 1, wherein provision is made of a driving means which rotates said sub-shaft only during the step of premixing and rotates said sub-shaft and said main shaft during the step of dispersion.

3. A dispersing apparatus according to claim 1, wherein said apparatus body is allowed to turn in a horizontal direction, and a washing tank and a plurality of tanks are provided to surround said apparatus body at such positions where said basket and said secondary vanes can be inserted therein or removed therefrom.

4. A dispersing apparatus according to claim 3, wherein a table is secured to the upper end of a cylinder, two guide bars are protruded from the lower surface of the table in parallel with the axial direction of the cylinder, the two guide bars being allowed to slide up and down inside cylindrical guides secured to the outer peripheral wall of the box in parallel with the axial direction of the cylinder penetrating through a base, and a gear forming a rack along the outer peripheral surface thereof is provided on the upper surface of the table via a thrust bearing of a large diameter to rotate in the horizontal direction, the apparatus body is secured to the upper surface of the gear, and a pinion is provided that meshes with the gear.

5. A dispersing apparatus according to claim 3, wherein the inner peripheral surface of the gear has an upper portion of a large diameter and a lower portion of a small diameter, the outer peripheral edge of a set ring is placed on an upper surface of the inner periphery of the small-diameter portion, a lock bolt is protruded from the lower surface of the set ring, the end of the lock bolt is allowed to penetrate through the table, and a lock nut which is integrally formed together with a lever is fitted to the end.

6. A dispersing apparatus according to claim 1, wherein said tank has a diameter which is about two or more times as great as the diameter of the basket.

7. In a dispersing apparatus wherein primary vanes are attached via a support member to a main shaft that is rotatably provided in an apparatus body that can be moved up and down, and are rotated in a basket that contains dispersing media and has numerous pores formed in the side wall thereof to permit the passage of a blend, in order to disperse the liquid blend that contains solid matters such as paints, inks and like pigments in the tank, the improvement wherein an annular top flange having a sleeve that protrudes in the peripheral direction of the basket is provided at an upper portion of the side wall of the basket, rods are coupled to the sleeve of said top flange to secure said basket to the apparatus body, a top cover is provided on said top flange, said top cover having an opening at the center thereof and further having the outer periphery which in cross section is downwardly inclined toward the center of said opening, and a stirrer means made up of grooves and/or vanes is provided on the upper surface of the support member that is located under the opening of said top cover.

8. A dispersing apparatus according to claim 7, wherein provision is made of a stirrer means which comprises a plurality of grooves and/or vanes formed on the upper surface of said support member in the radial direction maintaining an equal distance extending from the outer peripheral edge of the main shaft or from the vicinities thereof to the outer peripheral edge of the support member or to the vicinities thereof forming a square shape in cross section.

9. A dispersing apparatus according to claim 7, wherein said top cover has an inclined surface of which the outer periphery in cross section is downwardly inclined by an angle of 20 to 40 degrees toward the center of said opening.

10. In a dispersing apparatus wherein a basket containing dispersing media is secured to an apparatus body that can be moved up and down by coupling rods to a sleeve that is formed in a protruding manner in a circumferential direction at an upper part of the side wall of the basket, and the apparatus body is provided with a main shaft and a sub-shaft that are rotated by a driving means, the main shaft and the sub-shaft being provided with primary vanes and secondary vanes, respectively, so as to rotate in the basket and under the basket to disperse a liquid blend that contains solid matters such as paints, inks and like pigments, the improvement wherein a number of wires having a circular shape in cross section are supported in the up-and-down direction maintaining a very small gap in at least part of the side wall of the basket, and slits are formed by the wires that are opposing to each other in the up-and-down direction and by the poles that are opposing in the circumferential direction.

11. A dispersing apparatus according to claim 10, wherein said poles are disposed in the circumferential direction of the side wall of the basket maintaining a suitable distance, the axes of the poles being oriented in the up-and-down direction, a number of wire grooves are formed in the Surfaces of the poles that are facing the circumferential direction of the side wall maintaining a very small gap in the up-and-down direction, and wires are inserted in these Opposing wire holes in order to form slits of a very small gap among the wires that are opposing in the up-and-down direction.

* * * * *